US009595788B1

(12) United States Patent
Luksic et al.

(10) Patent No.: US 9,595,788 B1
(45) Date of Patent: Mar. 14, 2017

(54) ELECTRICAL CONNECTOR HAVING A FLEXIBLE LATCH ACTUATED BY A RAMP ON A RELEASE COLLAR

(71) Applicant: TYCO ELECTRONICS CORPORATION, Berwyn, PA (US)

(72) Inventors: Marek Tadeusz Luksic, Dillsburg, PA (US); Matthew Edward Mostoller, Hummelstown, PA (US); Edward John Howard, Millersburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/137,786

(22) Filed: Apr. 25, 2016

(51) Int. Cl.
*H01R 13/62* (2006.01)
*H01R 13/627* (2006.01)
*H01R 13/629* (2006.01)

(52) U.S. Cl.
CPC ..... *H01R 13/6277* (2013.01); *H01R 13/629* (2013.01); *H01R 13/62933* (2013.01)

(58) Field of Classification Search
CPC ..... H01R 9/05; H01R 13/62; H01R 13/627; H01R 13/6271; H01R 13/6272; H01R 13/6275; H01R 13/629; H01R 13/62933; H01R 13/639; H01R 13/6397; H01R 33/97
USPC ..... 439/296, 298, 299, 304, 310, 352, 357, 439/578
See application file for complete search history.

(56) References Cited

U.S. PATENT DOCUMENTS

| | | | | |
|---|---|---|---|---|
| 2005/0059284 | A1* | 3/2005 | Thurston | H01R 13/623 439/314 |
| 2010/0330835 | A1* | 12/2010 | Rudolph | H01R 13/627 439/357 |
| 2011/0021041 | A1* | 1/2011 | Galloway | H01R 13/627 439/63 |
| 2014/0308009 | A1* | 10/2014 | Mulfinger | G02B 6/3893 385/75 |

* cited by examiner

*Primary Examiner* — Chandrika Prasad

(57) ABSTRACT

An electrical connector includes a housing holding power terminals and having a mating end with a flexible latch configured to engage a latch of a mating connector. The flexible latch includes a pull hook extending therefrom. A release collar is slidably coupled to the housing in an axial direction between a forward position and a rearward position. The release collar has an actuator ramp facing the pull hook. The actuator ramp engages the pull hook to actuate the flexible latch to release the flexible latch from the latch of the mating connector as the release collar is moved to the rearward position. The housing includes a locking finger engaging the release collar to lock the release collar in the forward position. The release collar is unlocked from the locking finger to move to the rearward position.

20 Claims, 8 Drawing Sheets

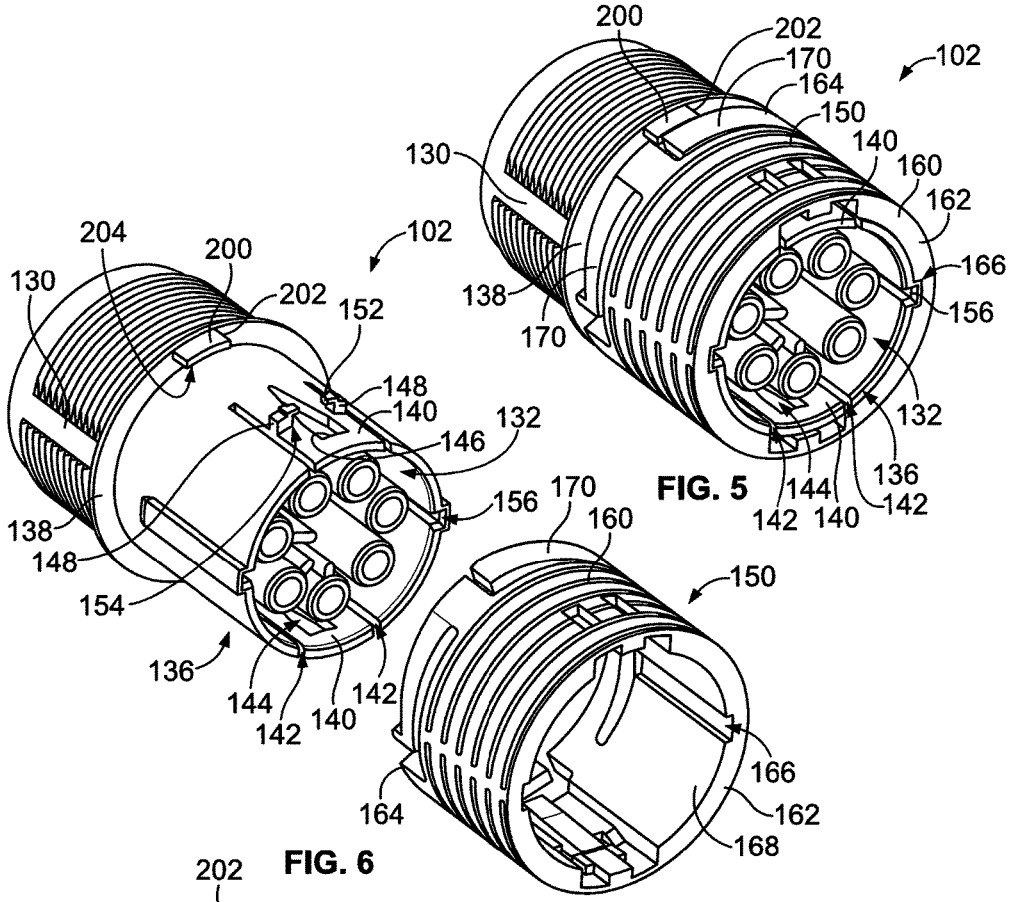
FIG. 5
FIG. 6
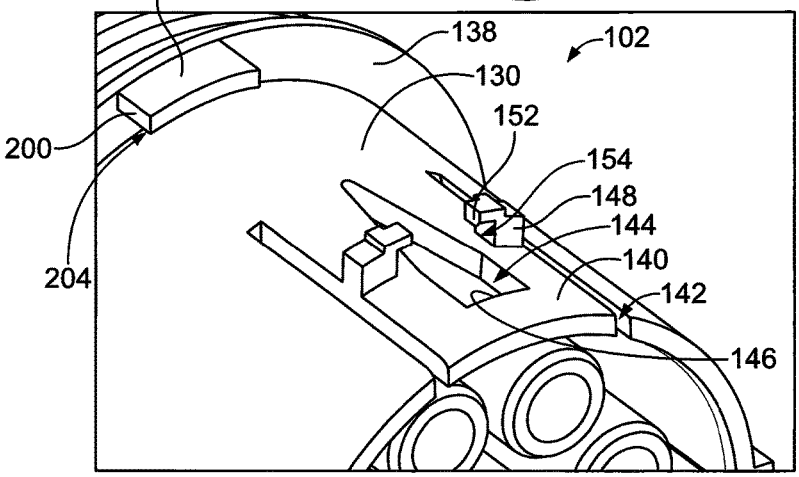
FIG. 7

ELECTRICAL CONNECTOR HAVING A FLEXIBLE LATCH ACTUATED BY A RAMP ON A RELEASE COLLAR

BACKGROUND OF THE INVENTION

The subject matter herein relates generally to electrical connectors having locking features for latch release collars.

Electrical connectors, such as power connectors, commonly have latches or other securing means to secure the electrical connectors together. For example, plug connectors have a static latch extending therefrom and socket connectors have a deflectable latch extending therefrom. However, the latches make the designs more complicated, costly and/or bulkier. Additionally, to uncouple the connectors, a separate tool is often required to release the flexible latch member to disengage the latches and allow uncoupling. Furthermore, with some designs, the latches may be inadvertently or unintentionally de-latched, causing the electrical connectors to uncouple.

A need remains for an electrical connector that avoids inadvertent de-latching of latches.

BRIEF DESCRIPTION OF THE INVENTION

In one embodiment, an electrical connector is provided including a housing having a cavity configured to receiving a mating connector. The housing holds power terminals in the cavity. The housing having a mating end and a flexible latch at the mating end configured to engage a latch of the mating connector. The flexible latch includes a pull hook extending therefrom. The electrical connector includes a release collar slidably coupled to the housing at the mating end in an axial direction between a forward position and a rearward position. The release collar has an actuator ramp facing the pull hook. The actuator ramp engages the pull hook to actuate the flexible latch to release the flexible latch from the latch of the mating connector as the release collar is moved to the rearward position. The housing includes a locking finger engaging the release collar to lock the release collar in the forward position. The release collar is unlocked from the locking finger to move to the rearward position.

In another embodiment, an electrical connector is provided including a housing having a cavity configured to receiving a mating connector. The housing holds power terminals in the cavity. The housing having a mating end and a flexible latch at the mating end configured to engage a latch of the mating connector. The flexible latch includes a pull hook extending therefrom. The electrical connector includes a release collar slidably coupled to the housing at the mating end in an axial direction between a forward position and a rearward position. The release collar has an actuator ramp facing the pull hook. The actuator ramp engages the pull hook to actuate the flexible latch to release the flexible latch from the latch of the mating connector as the release collar is moved to the rearward position. The housing includes a locking finger engaging the release collar to lock the release collar in the forward position. The release collar is unlocked from the locking finger to move to the rearward position. The release collar includes a spring engaging the locking finger. The spring is deflectable, the spring being released from the locking finger to allow the release collar to move to the rearward position.

In a further embodiment, an electrical connector is provided including a housing having a cavity configured to receiving a mating connector. The housing holds power terminals in the cavity. The housing has a mating end and a flexible latch at the mating end configured to engage a latch of the mating connector. The flexible latch having a pull hook extending therefrom. A release collar is slidably coupled to the housing at the mating end in an axial direction between a forward position and a rearward position. The release collar has an actuator ramp facing the pull hook. The actuator ramp engages the pull hook to actuate the flexible latch to release the flexible latch from the latch of the mating connector as the release collar is moved to the rearward position. The housing includes a locking finger engaging the release collar to lock the release collar in the forward position. The locking finger is deflectable from a locked position to an unlocked position to release the release collar and allow the release collar to move to the rearward position.

BRIEF DESCRIPTION OF THE DRAWINGS

FIG. 5 is a front perspective view of a socket connector of the electrical connector system in an assembled state.

FIG. 6 is an exploded view of the socket connector.

FIG. 7 is an enlarged view of a portion of the socket connector.

DETAILED DESCRIPTION OF THE INVENTION

Figure 1:
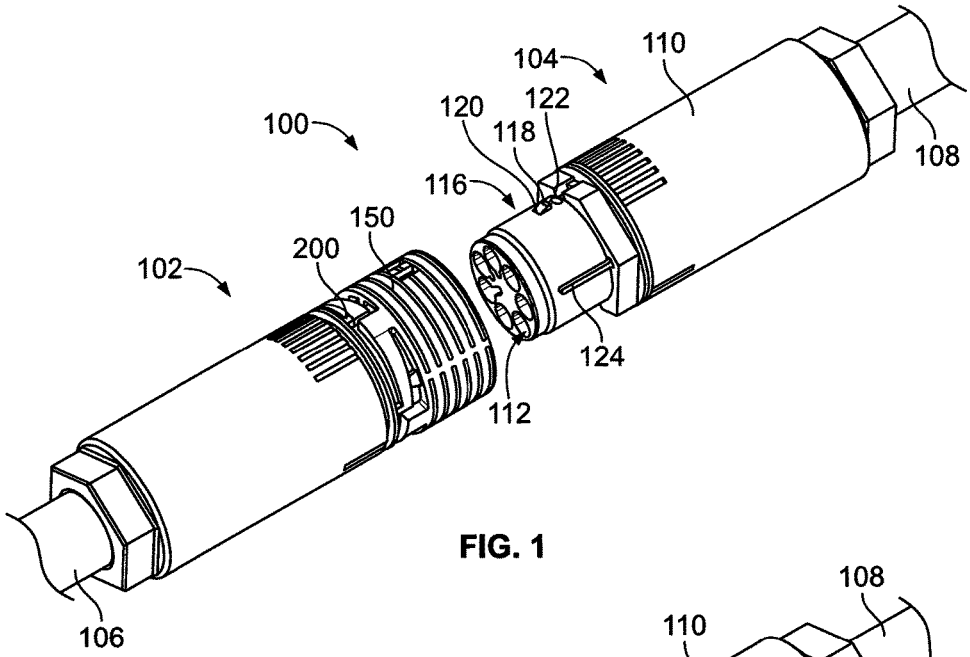
FIG. 1 is a perspective view of an electrical connector system formed in accordance with an exemplary embodiment showing first and second electrical connectors poised for mating.
Figure 2:
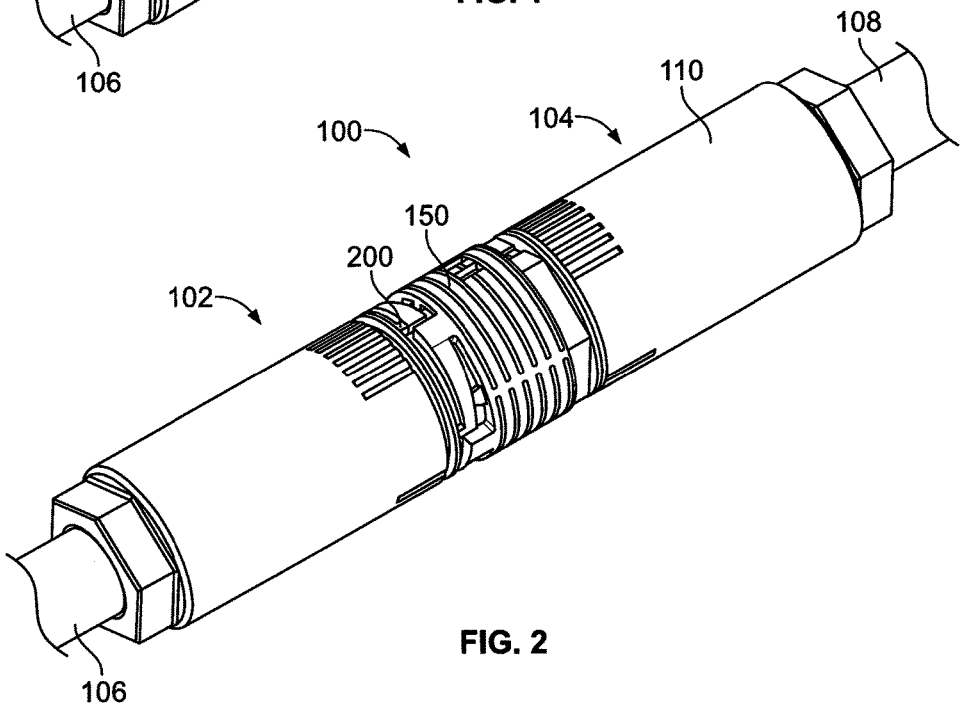
FIG. 2 is a perspective view of the electrical connector system showing the first and second electrical connectors mated together.
Figure 3:
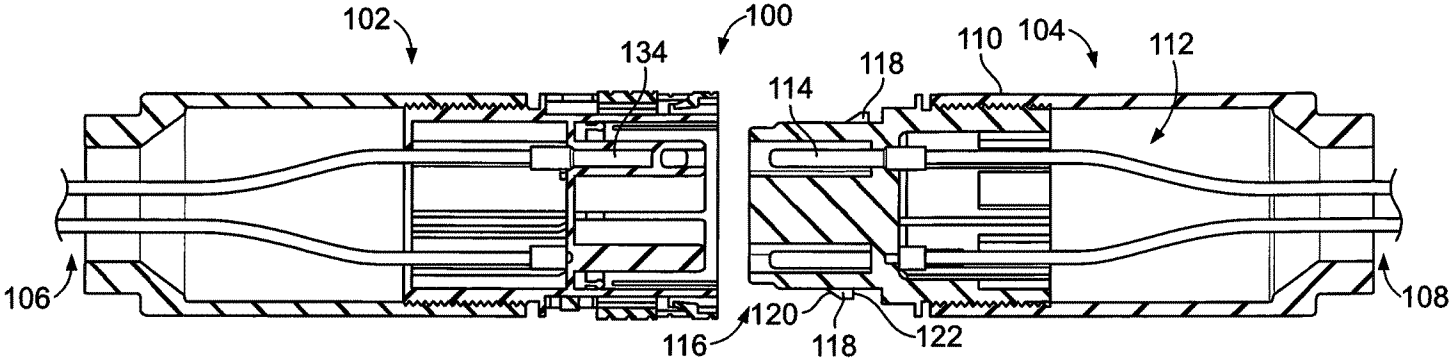
FIG. 3 is a cross-sectional view of the first and second electrical connectors.

FIG. 1 is a perspective view of an electrical connector system 100 formed in accordance with an exemplary embodiment showing first and second electrical connectors poised for mating. FIG. 2 is a perspective view of the electrical connector system 100 showing the first and second electrical connectors 102, 104 mated together. FIG. 3 is a cross-sectional view of the first and second electrical connectors 102, 104. Either of the electrical connectors 102 or 104 may be considered a mating connector 102 or 104 for the other electrical connector.

In the illustrated embodiment, the electrical connector 102 is a socket connector and may be referred to hereinafter as a socket connector 102 while the second electrical connector 104 is a plug connector and may be referred to as a plug connector 104 hereinafter. The socket connector 102 receives a mating end of the plug connector 104. In the illustrated embodiment, both electrical connectors 102, 104 are provided at ends of corresponding cables 106, 108. In an exemplary embodiment, the cables 106, 108 are power cables providing power to the electrical connectors 102, 104. The electrical connectors 102, 104 thus define power connectors and the electrical connector system 100 is a power connector system. However, the electrical connectors 102, 104 may transmit data signals in addition to or in the alternative to transmitting power. The cables 106, 108 may have individual wires terminated to corresponding terminals, such as power terminals, in the electrical connectors 102, 104.

The plug connector 104 includes a housing 110 having a cavity 112. The housing 110 holds a plurality of terminals 114 in the cavity 112. The wires of the cable 108 are terminated to corresponding terminals 114 within the cavity 112. The housing 110 has a mating end 116 opposite the cable end of the plug connector 104. In an exemplary embodiment, the housing 110 is a circular housing. The mating end 116 has a generally circular cross-section; however, the housing 110 may have other shapes in alternative embodiments. The terminals 114 are arranged circumferentially around the cavity 112 near the exterior of the housing 110; however the terminals 114 may have a different arrangement in alternative embodiments.

The plug connector 104 includes a latch 118 at the mating end 116 that is used for latching engagement with the socket connector 102. In the illustrated embodiment, the latch 118 is a static latch. Optionally, multiple latches 118 may be provided, such as on opposite sides of the housing 110. In the illustrated embodiment, the latch 118 includes a forward facing ramp surface 120 and a rear facing catch surface 122. The socket connector 102 includes a flexible latch configured to engage the latch 118 and is configured to be secured to the catch surface 122 to secure the socket connector 102 to the plug connector 104.

In an exemplary embodiment, the plug connector 104 includes guide features 124 to guide mating with the socket connector 102. In the illustrated embodiment, the guide features 124 are ribs extending along the exterior surface of the housing 110 at the mating end 116. Other types of guide features may be provided in alternative embodiments. The guide features 124 may provide keyed mating with the socket connector 102.

In an exemplary embodiment, the socket connector 102 includes a slidable release collar 150 to release the flexible latches of the socket connector 102 from the latches 118 of the plug connector 104. The socket connector 102 includes a locking finger 200 engaging the release collar 150 to lock the release collar 150 in a forward position. The release collar 150 may be unlocked from the locking finger 200 to then allow movement to a rearward position, where the release collar 150 releases the flexible latches of the socket connector 102 as the release collar 150 is moved rearward. The locking finger 200 prevents inadvertent or accidental de-latching due to movement of the release collar 150. Optionally, the locking finger 200 may only be unlocked by the use of a tool. Alternatively, the locking finger 200 may be unlocked without the use of a tool. In alternative embodiments, the release collar 150 may be provided on the plug connector 104 rather than the socket connector 102.

Figure 4:
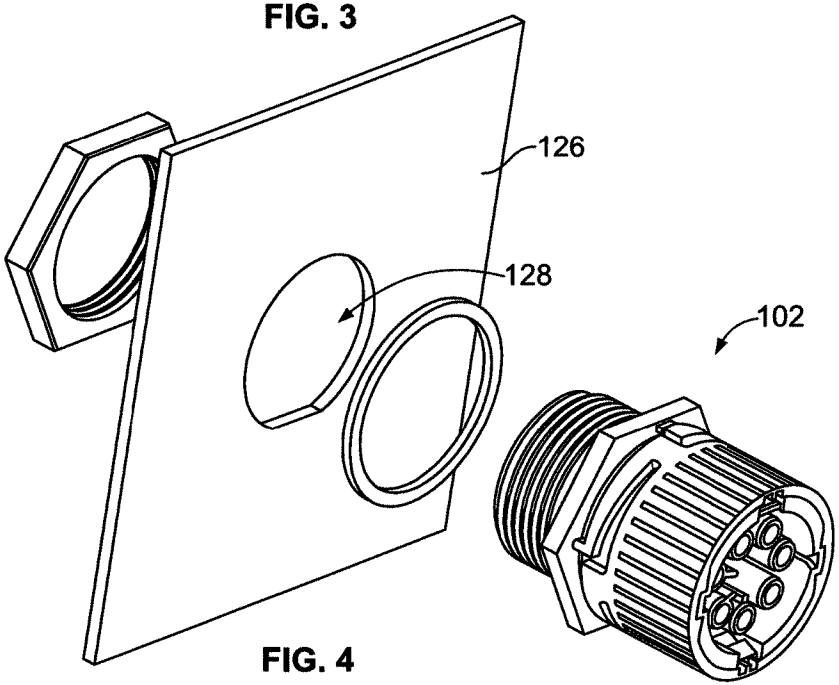
FIG. 4 is an exploded perspective view of a portion of the electrical connector system showing the socket connector in accordance with an exemplary embodiment.

FIG. 4 is an exploded perspective view of a portion of the electrical connector system 100 showing the socket connector 102 in accordance with an exemplary embodiment. In the illustrated embodiment, the socket connector 102 is configured to be mounted to a panel 126. The socket connector 102 passes through an opening 128 in the panel 126 and is secured to the panel 126 using a threaded coupling, such as a threaded nut received on external threads of the socket connector 102.

FIG. 5 is a front perspective view of the socket connector 102 in an assembled state. FIG. 6 is an exploded view of the socket connector 102. FIG. 7 is an enlarged view of a portion of the socket connector 102.

The socket connector 102 includes a housing 130 having a cavity 132 configured to receive a mating connector, such as the plug connector 104 (shown in FIG. 1). The housing 130 holds a plurality of terminals 134 (shown in FIG. 3) configured to be mated with corresponding terminals 114 (shown in FIG. 3) of the plug connector 104. In an exemplary embodiment, the terminals 134 are power terminals terminated to corresponding wires of the cable 106 (shown in FIG. 1). The housing 130 includes a mating end 136 generally opposite the cable end. In the illustrated embodiment, the housing 130 is a circular housing. The mating end 136 has a generally circular cross-section; however, the housing 130 may have other shapes in alternative embodiments. In an exemplary embodiment, the housing 130 includes a flange 138 rearward of the mating end 136.

The housing 130 includes flexible latches 140 configured to be latchably secured to corresponding latches 118 (shown in FIG. 1). In the illustrated embodiment, the housing 130 includes two flexible latches 140 on opposite sides of the housing 130; however, any number of flexible latches 140 may be provided in alternative embodiments. The flexible latches 140 have slots 142 on opposite sides of the flexible latch 140 allowing the flexible latch 140 to be deflected and released during latching and unlatching from the latch 118. The flexible latch 140 includes on opening 144 configured to receive the latch 118. The opening 144 may have any shape to receive the latch 118. In the illustrated embodiment, the opening 144 is defined at a front end thereof by a catch surface 146 configured to engage the catch surface 122 of the latch 118. The opening 144 may be elongated to make the flexible latch 140 more flexible.

In an exemplary embodiment, the flexible latch 140 includes one or more pull hooks 148 extending radially outward from the flexible latch 140. The pull hooks 148 are used to release the flexible latches 140. In the illustrated embodiment, the pull hooks 148 are approximately centered axially along the flexible latch 140; however, the pull hooks 148 may be provided at any location along the flexible latches 140, such as near the front end or near the rear end of the flexible latch 140. The pull hooks 148 may have any shape that facilitate interaction and release by a release collar 150 of the socket connector 102. In the illustrated embodiment, the pull hook 148 includes an overhang 152 with an undercut 154 defined between the overhang 152 and the exterior surface of the flexible latch 140. A portion of the release collar 150 is configured to be received in the undercut 154 and interacts with the overhang 152 to release the flexible latch 140 when the release collar 150 is actuated. In the illustrated embodiment, the pull hooks 148 are separate from each other; however, the pull hooks 148 may be connected in alternative embodiments, such as with a common overhang 152 defining a common undercut 154.

In an exemplary embodiment, the housing 130 includes one or more guide features 156 that interact with the guide features 124 (shown in FIG. 1) to guide mating of the socket connector 102 and the plug connector 104. In the illustrated embodiment, the guide features 156 are configured to receive the rib-shaped guide features 124 of the plug connector 104. For example, the guide features are closed to define channels; however, the guide features may be open in alternative embodiments defining slots configured to receive the rib-shaped guide features 124. In an exemplary embodiment, the guide features 156 are configured to interact with the release collar 150 to guide mating and actuation of the release collar 150 relative to the housing 130.

The release collar 150 includes a ring-shaped body 160 configured to be received over the mating end 136 of the housing 130. The release collar 150 extends between a front end 162 and a rear end 164. The body 160 includes guide features 166 extending axially along an interior surface 168 thereof. The guide features 166 interact with the guide features 156 of the housing 130 to guide mating with the housing 130 and to orient the release collar 150 relative to the housing 130. In the illustrated embodiment, the guide features 166 are channels that receive the guide features 156; however, other types of guide features may be provided in alternative embodiments. Optionally, the guide features 166 may guide movement of the release collar 150 relative to the housing 130. For example, the guide features 166 may limit movement of the release collar 150 to axial translational movement, such as during actuation of the release collar 150. The guide features 166 may limit or restrict rotational movement of the release collar 150 relative to the housing 130.

The release collar 150 is slidably coupled to the housing 130 at the mating end 136 in an axial direction between the forward position and a rearward position. For example, the release collar 150 may be slid rearward from the forward position to the rearward position after the release collar 150 is unlocked from the locking finger 200. The rearward movement of the release collar 150 relative to the housing 130 causes the release collar 150 to actuate and release the flexible latches 140.

In an exemplary embodiment, the release collar 150 includes springs 170 at the rear end 164. The springs 170 engage the flange 138 of the housing 130 to hold the release collar 150 at a forward position relative to the housing 130. For example, the springs 170 may be biased against the flange 138 to push the release collar 150 in a forward axial direction to the forward position. In an exemplary embodiment, the springs 170 are integral with the body 160 of the release collar 150. Alternatively, a separate spring or springs 170 may be provided between the flange 138 and the rear end 164 of the body 160. In the illustrated embodiment, the springs 170 have spring arms extending in a circumferential direction at least partially around the housing 130. The springs 170 may have spring fingers extending from the spring arms to engage the flange 138. The body 160 includes relief pockets at the rear end 164 aligned with the springs 170. The locking finger 200 holds one of the springs 170 in the relief pocket blocking the rear end 162 of the release collar 150 from moving to the rearward position. The other relief pockets are configured to receive the corresponding springs 170 when the release collar 150 is slid rearward. The springs 170 bias the release collar 150 to the forward position. Optionally, in the forward position, the front end 162 of the release collar 150 may be generally flush with the front of the housing 130; however, the front end 162 may be positioned forward or rearward of the front of the housing 130 in alternative embodiments.

In an exemplary embodiment, the release collar 150 includes actuator ramps 180 that are configured to interact with corresponding pull hook 148 on the flexible latches 140 to actuate and release the flexible latches 140. The actuator ramps 180 may be wedged under the pull hooks 148 as the release collar 150 is slid rearward to force the flexible latches 140 to spread outward and release from the latches 118. The actuator ramps 180 extended inward from the interior surface 168. The actuator ramps 180 are axially aligned with the pull hooks 148 and are configured to engage the pull hooks 148 when the release collar 150 is pulled rearward.

The socket connector 102 includes the locking finger 200, which engages the release collar 150 to lock the release collar 150 in the forward position to prevent inadvertent or accidental de-latching due to movement of the release collar 150. In the illustrated embodiment, the locking finger 200 is integral with the housing 130. The locking finger 200 includes a tab 202 that blocks the release collar 150. In the illustrated embodiment, the tab 202 extends forward from the flange 138; however the tab 202 may extend from other portions of the housing 130 in alternative embodiments, such as from an exterior of the housing 130 at the mating end 136.

In an exemplary embodiment, the tab 202 engages one of the springs 170 to block rearward movement of the release collar 150. The spring 170 may be released from the tab 202 to a clearance position to allow the release collar 150 to then move rearward. For example, the spring 170 may be moved from a locked position to an unlocked position, in which the spring is clear of the tab 202 and the release collar 150 is then free to move rearward. A relief pocket 204 (FIG. 6) is defined between the tab 202 and the exterior of the housing 130. The release collar 150 is movable into the relief pocket 204 when the release collar 150 is unlocked from the locking finger 200. For example, the spring 170 may be released from the tab 202 into the relief pocket 204 to allow the release collar 150 to be moved rearward. Optionally, the spring 170 is moved into the relief pocket 204 as the release collar 150 is slid rearward. In the locked position, the spring 170 is aligned with and may engage the tab 202. The locked spring 170 engages and/or blocks the rear end 164 from moving rearward. In the unlocked position, the spring 170 is disengaged from the tab 202, such as into the relief pocket 204, such that the spring 170 is no longer blocking rearward movement of the release collar from the forward position. The release collar 150 is able to move to the rearward position. In alternative embodiments, rather than having the relief pocket 204 below the tab 202, the spring 170 may move to another unlocked position, such as above (for example, radially outward of) the tab 202. Optionally, the spring 170 must be moved forward prior to being pressed to the clearance or unlocked position, such as to clear a locking portion of the tab 202.

Figure 8:
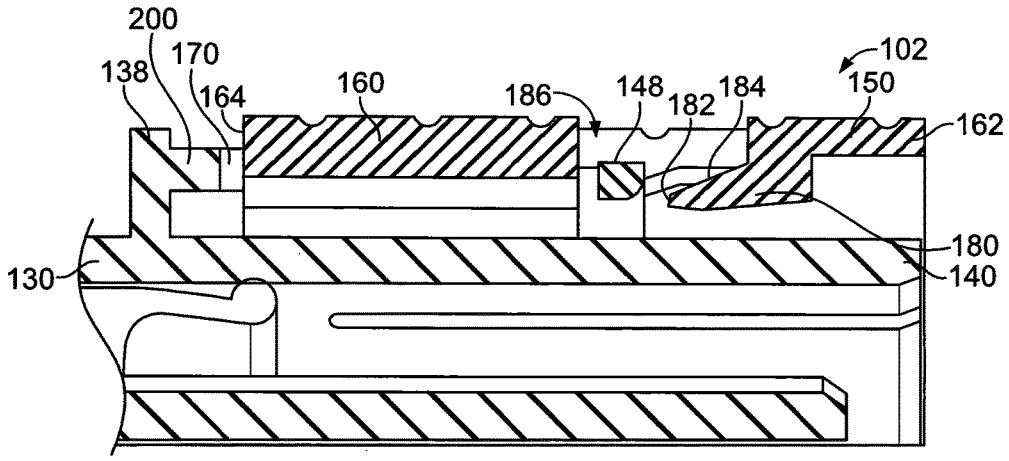
FIG. 8 is a cross-sectional view of a portion of the socket connector showing a release collar thereof in a forward position.
Figure 9:
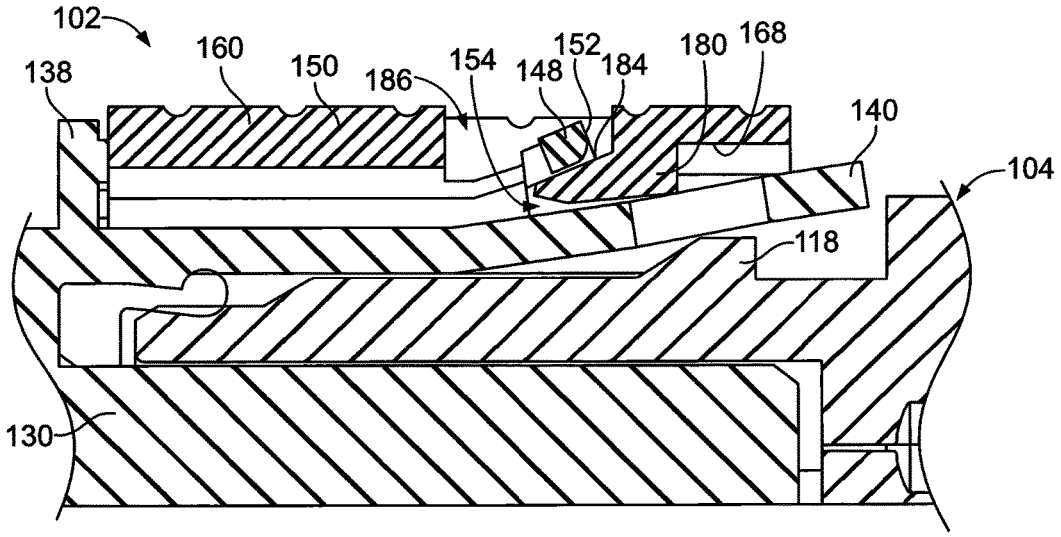
FIG. 9 is a cross-sectional view of a portion of the socket connector and a plug connector of the electrical connector system showing the release collar in the rearward position.

FIG. 8 is a cross-sectional view of a portion of the socket connector 102 showing the release collar 150 in the forward position. FIG. 9 is a cross-sectional view of a portion of the socket connector 102 and the plug connector 104 showing the release collar 150 in the rearward position and the flexible latch 140 released from the corresponding latch 118 of the plug connector 104.

In the forward position, the actuator ramp 180 is aligned axially forward of the pull hook 148 on the corresponding flexible latch 140. Optionally, the actuator ramp 180 is disengaged from the pull hook 148 in the forward position (FIG. 8). For example, the actuator ramp 180 is forward of the pull hook 148 in the forward position. Alternatively, the actuator ramp 180 may engage the pull hook 148 in the forward position.

The actuator ramp 180 extends to a distal end 182 and includes a ramp surface 184 that is configured to engage the pull hook 148. In an exemplary embodiment, the release collar 150 includes an opening 186 radially outward of the actuator ramp 180. The opening 186 is configured to receive the pull hook 148. For example, when the actuator ramp 180 engages the pull hook 148 and forces the pull hook 148 outward, the pull hook 148 is received in the opening 186. Optionally, the ramp surface 184 and/or the forward facing surface of the pull hook 148 may be curved to provide a lead-in and to reduce the risk of binding the actuator ramp 180 against the pull hook 148 when the release collar 150 is slid rearward.

During use, after the release collar 150 is unlocked from the locking finger 200 (shown in FIG. 7), the release collar 150 is moved axially rearward to release the flexible latches 140, such as from the latches 118. As the release collar 150 is moved rearward (FIG. 9), the actuator ramp 180 engages the pull hook 148 to force the pull hook 148, and thus the flexible latch 140 radially outward as the release collar 150 and the actuator ramp 180 are slid rearward to the rearward position. The actuator ramp 180 is received in the undercut 154 between the overhang 152 and the flexible latch 140. The overhang 152 engages the ramp surface 184 and rides along the ramp surface 184 to force the flexible latch 140 to move radially outward as the release collar 150 is moved axially rearward. The actuator ramp 180 extends inward from the interior surface 168 of the body 160 and faces the exterior surface of the housing 130. The pull hook 148, such as the overhang 152, is received in the space between the actuator ramp 180 and the interior surface 168. As the actuator ramp 180 drives the pull hook 148 and flexible latch 140 outward, the pull hook 148 is at least partially received in the opening 186 as the pull hook 148 and the flexible latch 140 are released from the latch 118.

Figure 11:
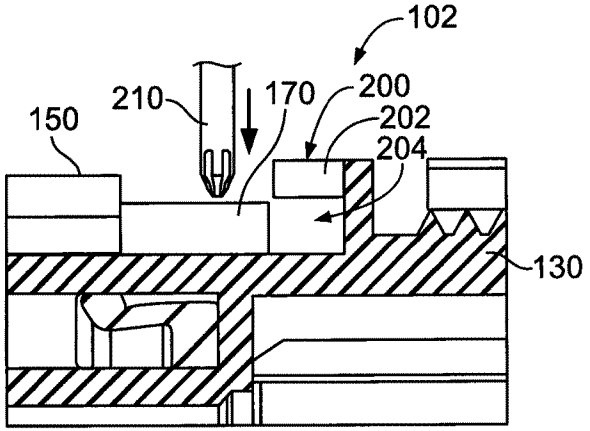
FIG. 11 is a cross-sectional view of a portion of the socket connector showing the release collar and locking finger in a forward and unlocked position.
Figure 10:
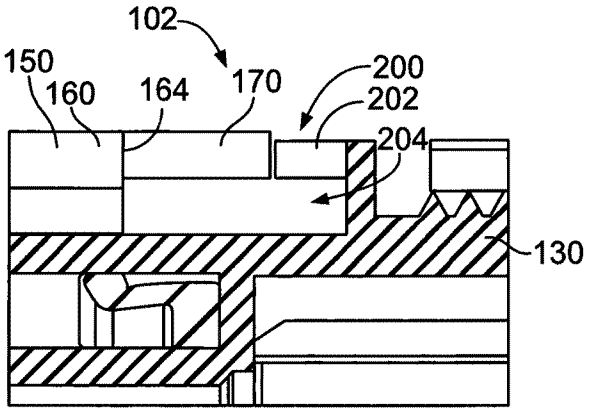
FIG. 10 is a cross-sectional view of a portion of the socket connector showing the release collar and a locking finger of the socket connector in a forward and locked position.
Figure 13:
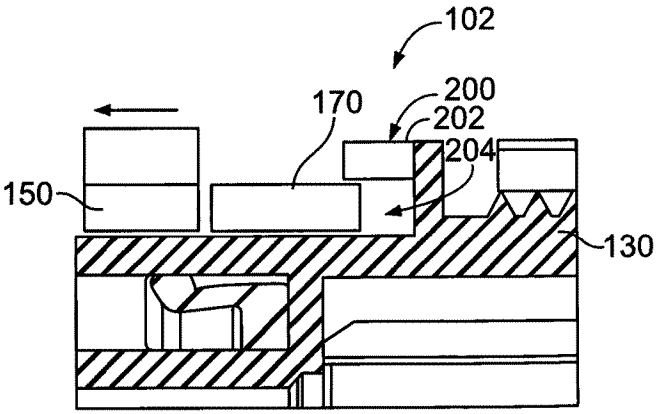
FIG. 13 is a cross-sectional view of a portion of the socket connector showing the release collar moving toward the forward position.
Figure 12:
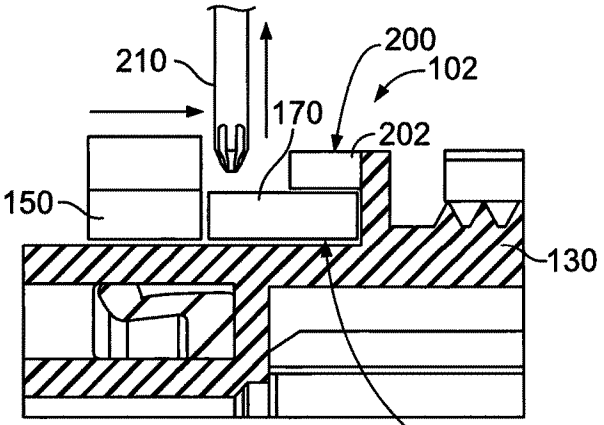
FIG. 12 is a cross-sectional view of a portion of the socket connector showing the release collar and the locking finger in a rearward and unlocked position.

FIG. 10 is a cross-sectional view of a portion of the socket connector 102 showing the release collar 150 and the locking finger 200 in a forward and locked position. FIG. 11 is a cross-sectional view of a portion of the socket connector 102 showing the release collar 150 and locking finger 200 in a forward and unlocked position. FIG. 12 is a cross-sectional view of a portion of the socket connector 102 showing the release collar 150 and the locking finger 200 in a rearward and unlocked position. FIG. 13 is a cross-sectional view of a portion of the socket connector 102 showing the release collar 150 moving toward the forward position.

In the locked position, the spring 170 is aligned with the tab 202 to block rearward movement of the release collar 150. For example, the spring 170 may substantially or entirely fill the space between the tab 202 and the rear end 164 of the body 160 of the release collar 150. Pulling of the release collar 150 in the rearward direction is blocked by the spring 170 and the locking finger 200. In various embodiments, the spring 170 used for locking the release collar 150 (for example, a locking spring) may be identical to the other springs 170 used to return the release collar 150 to the forward position (for example, return springs). Alternatively, the locking spring 170 may be sized, shaped or located differently than the springs 170 used to return the release collar 150 to the forward position.

The release collar 150 is unlocked from the locking finger 200 to allow rearward movement of the release collar 150. In an exemplary embodiment, the spring 170 is unlocked from the locking finger 200 by pressing the spring 170 toward the housing 130. When the spring 170 is aligned with the relief pocket 204, the spring 170 may be received in the relief pocket 204 such that the locking finger 200 no longer blocks rearward movement of the spring 170 and the release collar 150. Optionally, the spring 170 may be moved to the unlocked position by a tool 210. Optionally, if the release collar 150 is not pulled rearward after the spring 170 is released, the spring 170 may deflect outward and return to the locked position. As such, in an exemplary embodiment, the spring 170 must be moved inward and the release collar 150 must be pulled rearward simultaneously for the release collar 150 to move to the rearward position.

In the rearward position (FIG. 12), the spring 170 is received in the relief pocket 204 between the tab 202 and the housing 130. The spring 170 may engage the flange 138 in the rearward position. When the rearward pulling force of the release collar 150 is ceased (FIG. 13), the springs 170 force the release collar 150 to move forward and return to the forward position. Once the spring 170 clears the tab 202, the spring 170 may automatically return to the locked position. Alternatively, the tool 210 may be used to return the spring 170 to the locked position or the operator may otherwise manually return the spring 170 to the locked position.

Figure 14:
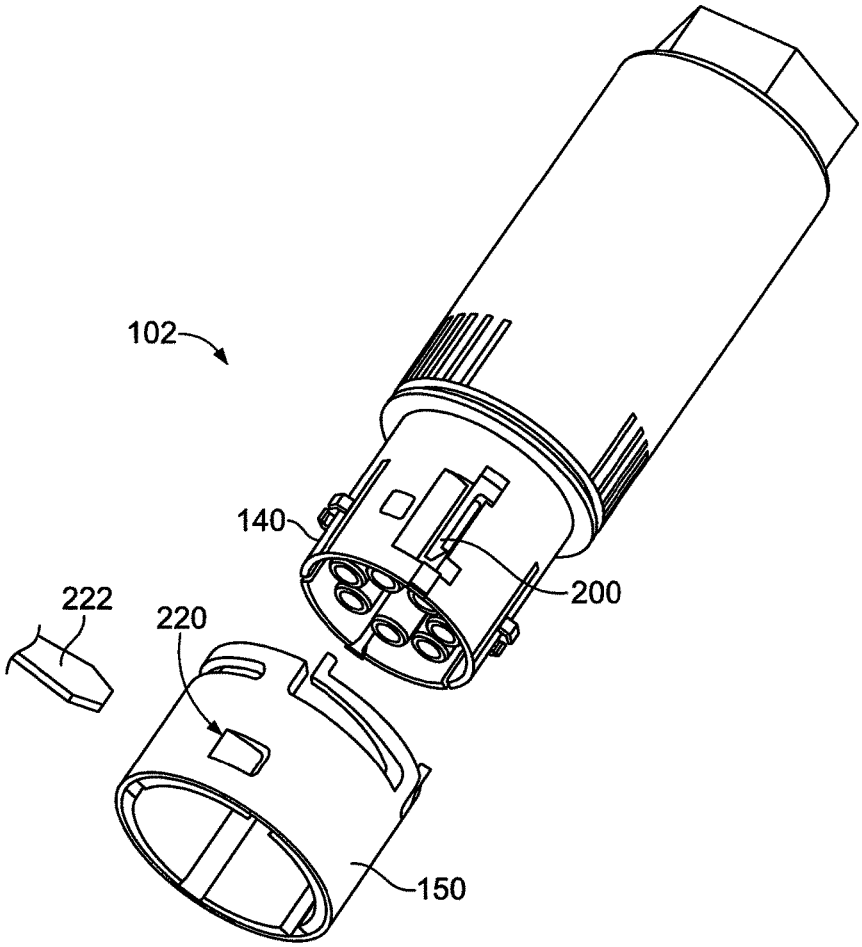
FIG. 14 is a perspective view of the socket connector in accordance with an exemplary embodiment.

FIG. 14 is a perspective view of the socket connector 102 in accordance with an exemplary embodiment. The socket connector 102 is similar to the socket connector shown in FIG. 1, however, the locking finger 200 of the socket connector 102 illustrated in FIG. 14 is deflectable and positioned at a different location than illustrated in FIG. 1. The release collar 150 includes an access port 220 for accessing the locking finger 200, such as with a tool 222, to unlock the locking finger 200 and allow release of the release collar 150 for de-latching the flexible latches 140. The locking finger 200 is deflectable from a locked position to an unlocked position to release the release collar 150. The locking finger 200 is configured to lock against the release collar 150 to block rearward movement of the release collar 150 when in the locked position.

Figure 15:
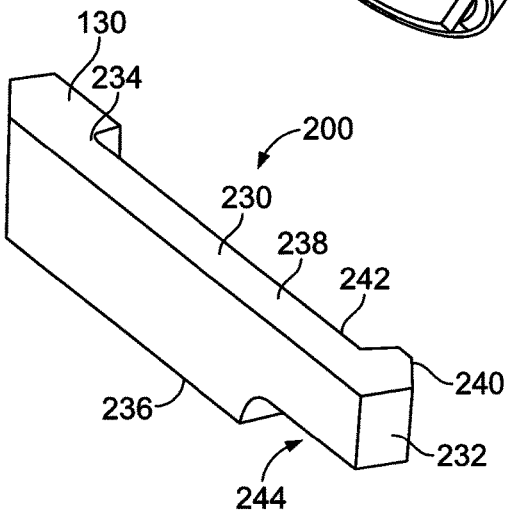
FIG. 15 illustrates the locking finger in accordance with an exemplary embodiment.

FIG. 15 illustrates the locking finger 200 in accordance with an exemplary embodiment. The locking finger 200 includes a deflectable arm 230 extending to a locking end 232 of the deflectable arm 230 from a fixed end 234. The fixed end 234 may be fixed to the housing 130 of the socket connector 102 (shown in FIG. 14). The locking end 232 is free to move, such as between the locked position and the unlocked position. The locking finger 200 has an inner end 236 and an outer end 238. The inner end 236 may face the cavity 132 while the outer end 238 faces the release collar 150 (both shown in FIG. 14).

In an exemplary embodiment, the locking finger 200 includes a ramp 240 at a side 242. The ramp 240 is used to actuate the locking finger 200, such as to the locked position. The ramp 240 is provided at the locking end 232. The ramp 240 may be provided at the outer end 238. In an exemplary embodiment, the locking finger 200 includes a recess 244 at the inner end 236, such as below the ramp 240. The recess 244 receives the tool 222 (shown in FIG. 14) to unlock the locking finger 200. The recess 244 is provided at the locking end 232.

Figure 16:
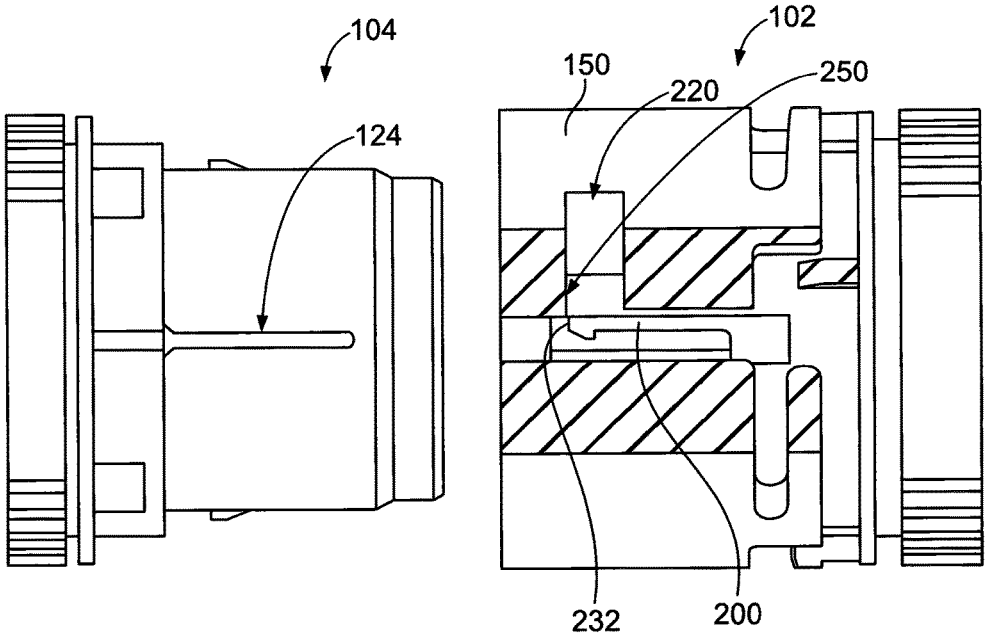
FIG. 16 illustrates the electrical connectors poised for mating.
Figure 18:
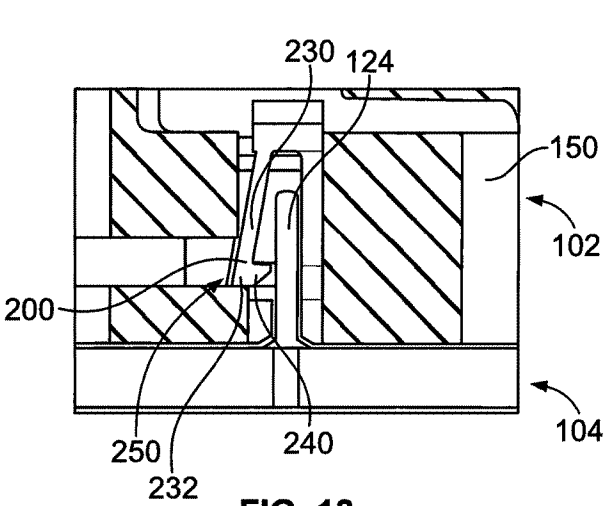
FIG. 18 illustrates the plug connector fully mated to the socket connector showing the locking finger in a locked position relative to the release collar.
Figure 17:
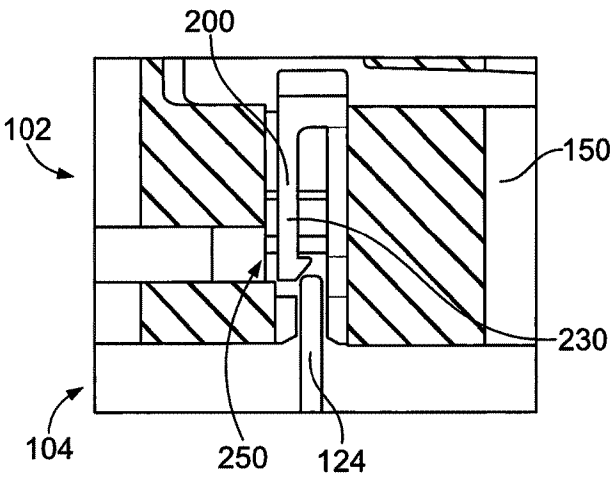
FIG. 17 illustrates the plug connector partially mated to the socket connector.
Figure 20:
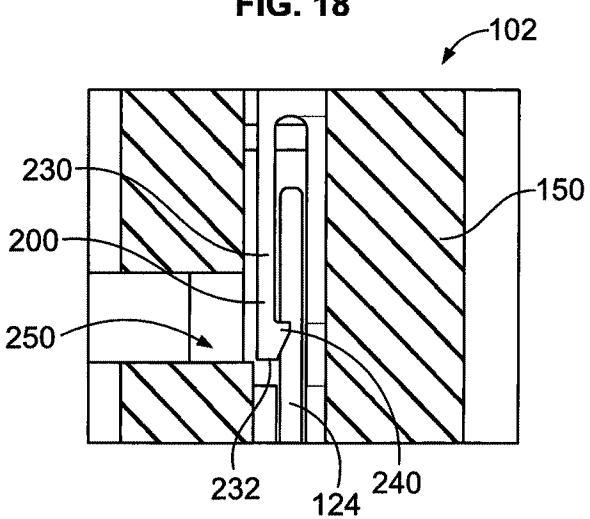
FIG. 20 illustrates the plug connector fully mated to the socket connector showing the locking finger unlocked and the release collar configured to be slid rearward to de-latch the latches and uncouple the electrical connectors.
Figure 19:
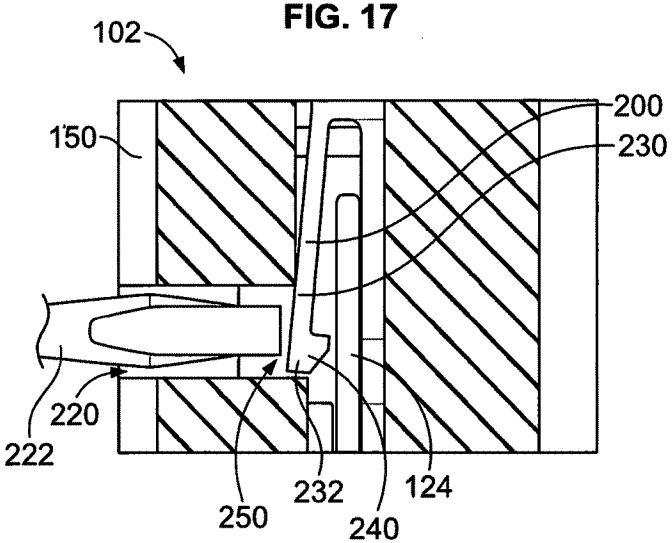
FIG. 19 illustrates the plug connector fully mated to the socket connector showing the tool configured to release the locking finger.

FIG. 16 illustrates the electrical connectors 102, 104 poised for mating. FIG. 17 illustrates the plug connector 104 partially mated to the socket connector 102. FIG. 18 illustrates the plug connector 104 fully mated to the socket connector 102 showing the locking finger 200 in a locked position relative to the release collar 150. FIG. 19 illustrates the plug connector 104 fully mated to the socket connector 102 showing the tool 222 configured to release the locking finger 200. FIG. 20 illustrates the plug connector 104 fully mated to the socket connector 102 showing the locking finger 200 unlocked and the release collar 150 configured to be slid rearward to de-latch the latches and uncouple the electrical connectors 102, 104. The release collar 150 is shown, partially in section, to illustrate the locking finger 200.

The release collar 150 includes a pocket 250 aligned with the locking finger 200, such as to one side of the locking finger 200. The locking finger 200 is configured to be received in the pocket 250 to lock the release collar 150 in the forward position. For example, in use, the locking end 232 of the deflectable arm 230 is received in the pocket 250 to lock the release collar 150 by blocking rearward movement of the release collar 150.

In an exemplary embodiment, the locking finger 200 is configured to engage the plug connector 104 when mated to the socket connector 102 and the plug connector 104 is used to actuate the locking finger 200 to the locked position. For example, the guide feature 124 (e.g., rib) of the plug connector 104 is configured to engage the locking finger 200 to push the locking finger 200 to the side into the pocket 250. The guide feature 124 engages the ramp 240 and forces the locking finger 200 to deflect into the pocket 250 (FIG. 18) to the locked position. During unlocking, the tool 222 is loaded into the access port 220 to engage the locking finger 200 and move the locking finger 200 out of the pocket 250. For example, the tool 222 may lift the locking finger 200 to clear the ramp 240 over the guide feature 124 (FIG. 19) to allow the locking finger 200 to move out of the pocket 250.

Figure 21:
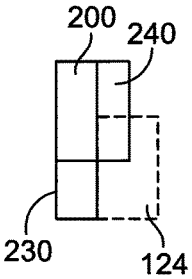
FIGS. 21-24 show a sequence of locking and unlocking of the locking finger relative to a guide feature of the plug connector.
Figure 22:
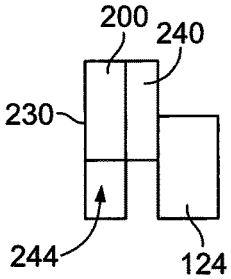
Figure 23:
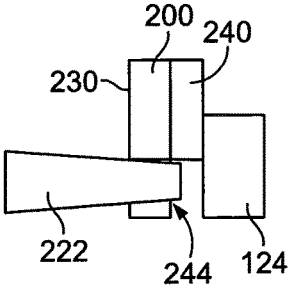
Figure 24:
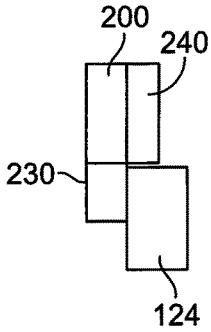

FIGS. 21-24 show a sequence of locking and unlocking of the locking finger 200 relative to the guide feature 124. FIG. 21 shows interference between the locking finger 200 and the guide feature 124. FIG. 22 shows the guide finger 124 forcing the locking finger 200 to the locked position. FIG. 23 shows the tool 222 releasing the locking finger 200 from the guide finger 124. FIG. 24 shows the locking finger 200 in the unlocked position.

The ramp 240 is aligned with the guide feature 124. When the plug connector 104 is mated with the socket connector 102, the guide feature 124 is pushed into the ramp 240 and the ramp 240 forces the locking finger 200 to shift in a blocking plane (e.g., in the horizontal plane in the illustrated orientation) between the locked position (FIG. 22) and the unlocked position (FIG. 21). In an exemplary embodiment, the deflectable arm 230 is released in a direction perpendicular to the blocking plane. For example, the tool 222 is received in the recess 244 below the ramp 240 and engages the deflectable arm 230. The tool 222 lifts the locking finger 200 to clear the ramp 240 over the guide feature 124 (FIG. 23) to allow the locking finger 200 to move to the unlocked position (FIG. 24).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a circular housing having a cavity configured to receiving a mating connector, the housing holding power terminals in the cavity, the housing having a mating end having a generally circular cross-section, the housing having a flexible latch at the mating end configured to engage a latch of the mating connector, the flexible latch having a pull hook extending therefrom; and a release collar slidably coupled to the housing at the mating end in an axial direction between a forward position and a rearward position, the release collar having an actuator ramp facing the pull hook, the actuator ramp engaging the pull hook to actuate the flexible latch to release the flexible latch from the latch of the mating connector as the release collar is moved to the rearward position;

wherein the housing includes a locking finger engaging the release collar to lock the release collar in the forward position, the release collar being unlocked from the locking finger to move to the rearward position.

2. The electrical connector of claim 1, wherein the release collar includes a spring engaging the locking finger, the spring being deflectable, the spring being released from the locking finger to allow the release collar to move to the rearward position.

3. The electrical connector of claim 1, wherein the locking finger includes a tab with a relief pocket between the tab and the housing, the tab blocking the release collar, the release collar being movable to the relief pocket to unlock from the locking finger.

4. The electrical connector of claim 3, wherein the release collar includes a spring between the release collar and the housing, the spring biasing the release collar to the forward position, the spring engaging the tab, the spring being released from the tab into the relief pocket to unlock the release collar from the locking finger.

5. The electrical connector of claim 1, wherein the release collar is unlocked from the locking finger by a tool.

6. The electrical connector of claim 1, wherein the locking finger is deflectable from a locked position to an unlocked position to release the release collar.

7. The electrical connector of claim 1, wherein the locking finger includes a deflectable arm, the release collar includes a pocket, a locking end of the deflectable arm being received in the pocket to block rearward movement of the release collar.

8. The electrical connector of claim 7, wherein the deflectable arm is configured to engage the mating connector to move to a locked position.

9. The electrical connector of claim 7, wherein the deflectable arm is movable in a blocking plane between a locked position and an unlocked position, the deflectable arm being released in a direction perpendicular to the blocking plane.

10. An electrical connector comprising:

a housing having a cavity configured to receiving a mating connector, the housing holding power terminals in the cavity, the housing having a mating end, the housing having a flexible latch at the mating end configured to engage a latch of the mating connector, the flexible latch having a pull hook extending therefrom; and a release collar slidably coupled to the housing at the mating end in an axial direction between a forward position and a rearward position, the release collar having an actuator ramp facing the pull hook, the actuator ramp engaging the pull hook to actuate the flexible latch to release the flexible latch from the latch of the mating connector as the release collar is moved to the rearward position;

wherein the housing includes a locking finger engaging the release collar to lock the release collar in the forward position, the release collar being unlocked from the locking finger to move to the rearward position; and wherein the release collar includes a spring engaging the locking finger, the spring being deflectable, the spring being released from the locking finger to allow the release collar to move to the rearward position.

11. The electrical connector of claim 10, wherein the locking finger includes a tab extending from the housing with a relief pocket between the tab and the housing, the tab blocking the release collar, the release collar being movable to the relief pocket to unlock from the locking finger.

12. The electrical connector of claim 11, wherein the spring biases the release collar to the forward position, the spring engaging the tab, the spring being released from the tab into the relief pocket to unlock the release collar from the locking finger.

13. The electrical connector of claim 10, wherein the housing includes a flange rearward of the mating end, the locking finger extending forward from the flange and defining a relief pocket between the locking finger and an exterior of the housing, the spring being released from the locking finger into the relief pocket to allow the release collar to move to the rearward position.

14. The electrical connector of claim 10, wherein the release collar is unlocked from the locking finger by a tool.

15. A electrical connector comprising:

a housing having a cavity configured to receiving a mating connector, the housing holding power terminals in the cavity, the housing having a mating end, the housing having a flexible latch at the mating end configured to engage a latch of the mating connector, the flexible latch having a pull hook extending therefrom; and a release collar slidably coupled to the housing at the mating end in an axial direction between a forward position and a rearward position, the release collar having an actuator ramp facing the pull hook, the actuator ramp engaging the pull hook to actuate the flexible latch to release the flexible latch from the latch of the mating connector as the release collar is moved to the rearward position;

wherein the housing includes a locking finger engaging the release collar to lock the release collar in the forward position, the locking finger being deflectable from a locked position to an unlocked position to release the release collar and allow the release collar to move to the rearward position.

16. The electrical connector of claim 15, wherein the locking finger includes a deflectable arm, the release collar includes a pocket, a locking end of the deflectable arm being received in the pocket to block rearward movement of the release collar.

17. The electrical connector of claim 16, wherein the deflectable arm is movable in a blocking plane between a blocking position and a clearance position, the deflectable arm being released in a direction perpendicular to the blocking plane.

18. The electrical connector of claim 15, wherein the locking finger is configured to engage the mating connector to move to the locked position.

19. The electrical connector of claim 15, wherein the release collar is unlocked from the locking finger by a tool.

20. The electrical connector of claim 15, wherein the release collar includes a spring engaging the housing, the spring biasing the release collar to the forward position.

* * * * *